US010118312B2

(12) United States Patent
Yun

(10) Patent No.: US 10,118,312 B2
(45) **Date of Patent: *Nov. 6, 2018**

(54) APPARATUS AND METHOD FOR MANUFACTURING HIGH PERFORMANCE CONCRETE CAPABLE OF MANUFACTURING HIGH PERFORMANCE CONCRETE THROUGH PROCESSES OF INSERTING AIR INTO NORMAL CONCRETE AND DISSIPATING AIR

(71) Applicant: KANGWON NATIONAL UNIVERSITY University-Industry Cooperation Foundation, Gangwon-do (KR)

(72) Inventor: Kyong Ku Yun, Seoul (KR)

(73) Assignee: Kangwon National University University—Industry Cooperation Foundation, Chuncheon-si, Gangwon-do (KR)

( * ) Notice: Subject to any disclaimer, the term of this patent is extended or adjusted under 35 U.S.C. 154(b) by 211 days.

This patent is subject to a terminal disclaimer.

(21) Appl. No.: 14/903,052

(22) PCT Filed: Jul. 3, 2014

(86) PCT No.: PCT/KR2014/005927

§ 371 (c)(1),
(2) Date: Jan. 5, 2016

(87) PCT Pub. No.: WO2015/002472

PCT Pub. Date: Jan. 8, 2015

(65) Prior Publication Data

US 2016/0151933 A1 Jun. 2, 2016

(30) Foreign Application Priority Data

Jul. 5, 2013 (KR) ..... 10-2013-0079163
Nov. 28, 2013 (KR) ..... 10-2013-0145990

(51) Int. Cl.
*B28C 5/46* (2006.01)
*B28C 5/08* (2006.01)
(Continued)

(52) U.S. Cl.
CPC ..... *B28C 5/0806* (2013.01); *B01F 5/0057* (2013.01); *B01F 5/048* (2013.01);
(Continued)

(58) Field of Classification Search
USPC ..... 366/3, 320
See application file for complete search history.

(56) References Cited

U.S. PATENT DOCUMENTS 3,848,810 A * 11/1974 Geisler ..... E04G 21/02 239/417.3
3,938,786 A * 2/1976 Bernold ..... B28C 5/026 366/13
(Continued)

FOREIGN PATENT DOCUMENTS

JP 2012-162418 A 8/2012
KR 10-2000-0055032 A 9/2000
(Continued)

*Primary Examiner* — Mark Halpern
(74) *Attorney, Agent, or Firm* — Rabin & Berdo, P.C.

(57) ABSTRACT

Disclosed is an apparatus and method for manufacturing high-performance concrete by introducing air into normal concrete and dissipating air, wherein high-performance concrete is formed in a manner in which bubbles, which are to be removed, are added in a large amount together with an admixture to pre-blended normal concrete so that the admixture is uniformly dispersed in the normal concrete using the ball-bearing effect of the bubbles, thus forming mixed concrete, and the mixed concrete is discharged using air at a high pressure of 5 atom or more to thereby shoot high-performance concrete of which the slump, remarkably increased due to the large amount of bubbles, is reduced to
(Continued)

fall within the range of slump of normal concrete while dissipating excess air from the mixed concrete.

17 Claims, 13 Drawing Sheets

(51) Int. Cl.

| | |
|---|---|
| ***B28C 5/12*** | (2006.01) |
| ***B01F 5/00*** | (2006.01) |
| ***B01F 5/04*** | (2006.01) |
| ***B01F 9/08*** | (2006.01) |
| ***B01F 13/10*** | (2006.01) |
| ***B01F 15/02*** | (2006.01) |
| ***B28C 5/00*** | (2006.01) |
| ***B28C 5/18*** | (2006.01) |
| ***B28C 5/38*** | (2006.01) |

(52) U.S. Cl.
CPC ..... *B01F 9/08* (2013.01); *B01F 13/103* (2013.01); *B01F 15/0251* (2013.01); *B01F 15/0289* (2013.01); *B28C 5/006* (2013.01); *B28C 5/1261* (2013.01); *B28C 5/1269* (2013.01); *B28C 5/1806* (2013.01); *B28C 5/381* (2013.01); *B28C 5/46* (2013.01)

(56) References Cited

U.S. PATENT DOCUMENTS 4,046,357 A * 9/1977 Twitchell ..... B05B 7/149 239/151
4,106,111 A * 8/1978 Rose ..... B01F 3/068 366/10
4,293,227 A * 10/1981 Tanaka ..... B28C 7/06 239/304
4,440,499 A * 4/1984 Tomikawa ..... B28C 5/123 366/10
4,618,294 A * 10/1986 Brown ..... B65G 53/4616 222/427
4,637,731 A * 1/1987 Dahlin ..... B28C 5/385 366/320
4,824,022 A * 4/1989 Hillemeier ..... E04F 21/12 239/407
4,964,731 A * 10/1990 Virtanen ..... E04G 21/04 118/323
5,730,523 A 3/1998 Flood
5,795,108 A * 8/1998 Lightle ..... B65G 53/12 406/123
6,354,726 B2 * 3/2002 Foerster ..... B01F 15/028 366/13
6,357,905 B1 * 3/2002 Birchard ..... B01F 5/221 366/178.1
6,749,330 B2 * 6/2004 Allen ..... B01F 5/02 366/136
6,843,592 B2 * 1/2005 Taylor ..... E01C 19/1072 366/141
7,766,537 B2 * 8/2010 Gembala ..... B01F 3/04446 261/DIG. 26
7,841,849 B2 * 11/2010 Khoshnevis ..... B01F 3/1221 425/200
8,550,690 B2 * 10/2013 Hines ..... B01F 13/1055 366/138
8,696,190 B2 * 4/2014 Arakelyan ..... E04F 21/10 366/2
9,180,605 B2 * 11/2015 Long ..... B28C 7/0418
2007/0082080 A1 * 4/2007 Sandqvist ..... B28B 1/084 425/456
2007/0238415 A1 * 10/2007 Sinha ..... G10L 19/0208 455/66.1
2013/0170314 A1 * 7/2013 Hansson ..... B01F 5/0057 366/3
2015/0122153 A1 * 5/2015 Warner ..... C04B 28/32 106/675
2015/0231797 A1 * 8/2015 Eilola ..... B28B 1/087 425/421
2016/0332915 A1 * 11/2016 Yun ..... B28C 5/003
2017/0080599 A1 * 3/2017 Yun ..... B28C 5/402

FOREIGN PATENT DOCUMENTS

KR 10-2008-0102975 A 11/2008
KR 10-0875240 B1 12/2008
KR 10-1069775 B1 10/2011
KR 10-1133569 B1 4/2012

* cited by examiner

APPARATUS AND METHOD FOR MANUFACTURING HIGH PERFORMANCE CONCRETE CAPABLE OF MANUFACTURING HIGH PERFORMANCE CONCRETE THROUGH PROCESSES OF INSERTING AIR INTO NORMAL CONCRETE AND DISSIPATING AIR

This application is a 371 of PCT/KR2014/005927 filed 3 Jul. 2014

TECHNICAL FIELD

The present invention relates to an apparatus and method for manufacturing high-performance concrete and, more particularly, to an apparatus and method for manufacturing high-performance concrete by introducing air into normal concrete and dissipating air, wherein high-performance concrete is formed in a manner in which bubbles, which are to be removed, are added in a large amount together with an admixture to pre-blended normal concrete so that the admixture is uniformly dispersed in the normal concrete using the ball-bearing effect of the bubbles, thus forming mixed concrete, and the mixed concrete is discharged using high-pressure air to thereby shoot high-performance concrete of which the slump, increased due to the large amount of bubbles, is reduced to fall within the range of slump of normal concrete while dissipating excess air from the mixed concrete.

BACKGROUND ART

Typically, lightweight foamed concrete is produced by introducing bubbles into lightweight concrete, and is configured such that a cured paste or mortar contains 20% or more of pores to thus decrease the density of concrete. When lightweight foamed concrete is produced only using a cement paste, it has a density of about 0.3 to 0.5 t/m$^2$, and when mortar containing fine aggregate is used, the resulting concrete density falls in the range of 0.8 to 1.5 t/m$^2$, and thus this concrete is mainly utilized in adiabatic applications in the form of blocks, panels and fillers on floors, walls, roofs and the like.

Lightweight foamed concrete is classified as either pre-foamed cellular concrete or post-foamed cellular concrete, depending on the sequence in which bubbles are generated. Pre-foamed cellular concrete, which is obtained by first generating bubbles and feeding the generated bubbles into a subsequent concrete manufacturing process, is employed with the goal of increasing lightweightness because the density thereof is lowered due to the pores therein, or of improving filling properties by increasing the slump using the ball-bearing effect of the bubbles.

With regard to pre-foamed cellular concrete, bubbles, which are preliminarily made, may be added to a cement paste (cement+water), mortar (cement+water+fine aggregate), or concrete (cement+water+fine aggregate+coarse aggregate), and are typically applied to a cement paste or mortar in order to realize desired lightweightness and filling properties. The use thereof in concrete that contains coarse aggregate is very rare. In particular, pre-foamed cellular concrete is formed by mixing preliminarily made bubbles with a cement paste or mortar so as to increase lightweightness and filling properties.

Also, lightweight foamed soil is used in the form of flowing concrete by blending pre-foamed bubbles with a cement paste and then mixing the blend with soil that has been sorted on-site in order to thus increase workability, and is a lightweight foamed material that has very low strength, thereby facilitating excavation for future repair. In this way, pre-foamed bubbles are utilized in non-structural concrete to ensure lightweightness and filling properties.

Pre-foamed cellular concrete is seldom used as a structural material. This is because an increase in air content by 1% results in a decrease in compressive strength of about 4%. For this reason, high-performance concrete, which uses coarse aggregate and is required to exhibit high strength, does not contain more than 20% air.

Compared to normal concrete comprising water, cement and aggregate, high-performance concrete exhibits high strength, high durability, and high flowability. Here, "high strength" means a strength of 35 MPa or more, "high durability" indicates a freeze-thaw resistance of 90% or more, and "high flowability" means concrete having very high workability. The above properties of high-performance concrete are obtained by using a powdered admixture, such as silica fume, flyash, slag powder, or metakaolin, and a chemical agent, such as an air-entraining agent, a high-performance flowing agent, or latex. Since both high strength and high durability have to be satisfied, the internal structure of the concrete is made dense, and the air content is controlled to about 3 to 6% to ensure freeze-thaw resistance.

Among the above materials, silica fume and a high-performance flowing agent are typically used in high-performance concrete. The silica fume is so fine that the size thereof is about 1/80 to 1/100 of the size of the cement powder for normal concrete. When silica fume is added to concrete, the inside of the concrete becomes denser due to the pozzolanic reaction that takes place therein, thereby assuring high strength and high durability. However, the specific surface area thereof is high, undesirably resulting in poor workability. Hence, silica fume is used together with a high-performance flowing agent.

Such silica fume is used in an amount of 7 to 10% based on the weight of the cement for normal concrete, and may be pre-blended with cement so as to be used in mixed cement form. When silica fume, which is very fine, is blended with other concrete materials upon blending concrete in an on-site batching plant (BP), silica fume is not uniformly dispersed, undesirably causing many problems. Furthermore, when silica fume is added in a powder phase to pre-blended concrete, it is not readily dispersed.

In order to produce high-performance concrete, a powdered admixture such as silica fume, flyash, blast slag powder, or metakaolin may be used. For dispersion of the admixture, mixed cement is utilized. In the case where the amount of mixed cement is large, an additional silo has to be provided in order to produce concrete in bulk in plants and then transfer it to the site. When the amount thereof is medium or small, concrete is supplied in the form of ton bags, undesirably increasing production costs due to additional processing and transport.

Moreover, when high-performance concrete is produced and supplied in an on-site batching plant, the entire cross-section of the structure of interest has to be constructed from high-performance concrete, undesirably increasing construction costs.

CITATION LIST

Korean Patent No. 10-0875240
Korean Patent No. 10-1069775

DISCLOSURE

Technical Problem

Accordingly, the present invention has been made keeping in mind the above problems occurring in the related art, and an object of the present invention is to provide an apparatus and method for manufacturing high-performance concrete by introducing air into normal concrete and dissipating air, in which normal concrete, comprising water, cement, aggregate, etc., which is transported to a site, is mixed with bubbles and an admixture, so that the admixture is efficiently dispersed in normal concrete using the ball-bearing effect of the bubbles, thus forming mixed concrete, and the mixed concrete is discharged using high-pressure air to thereby shoot high-performance concrete of which the slump, which is remarkably increased due to the large amount of bubbles, is reduced to fall within the range of slump of normal concrete while dissipating excess air from the mixed concrete.

Another object of the present invention is to provide an apparatus and method for manufacturing high-performance concrete by introducing air into normal concrete and dissipating air, in which high-performance concrete may be manufactured onsite only in the amount that is desired, thus reducing production and construction costs and consequently generating economic benefits.

Technical Solution

The present invention provides an apparatus for manufacturing high-performance concrete by introducing air into normal concrete and dissipating air, comprising: a normal concrete formation unit for forming normal concrete by blending water, cement, and aggregate at a predetermined ratio; a bubble and admixture feeding unit for feeding bubbles and an admixture to the normal concrete to increase a slump of the normal concrete; a mixed concrete formation unit, comprising a shaft that is rotated by power of a motor in an agitator truck containing the normal concrete, and a mixing member having one or more blades radially provided to the shaft to mix the normal concrete with the bubbles and the admixture, fed from the bubble and admixture feeding unit, thus forming mixed concrete; and a high-performance concrete shooting unit for shooting high-performance concrete of which a slump, increased due to the bubbles, is reduced to fall within a range of slump of normal concrete while dissipating the bubbles from the mixed concrete by discharging the mixed concrete using air at a high pressure of 5 atm or more.

In addition, the present invention provides a method of manufacturing high-performance concrete by introducing air into normal concrete and dissipating air, comprising: forming normal concrete by blending water, cement, and aggregate at a predetermined ratio; feeding bubbles and an admixture to the normal concrete so as to increase a slump of the normal concrete; forming mixed concrete by mixing the normal concrete with the bubbles and the admixture fed from a bubble and admixture feeding unit, using a shaft that is rotated by power of a motor in an agitator truck containing the normal concrete, and a mixing member having one or more blades radially provided to the shaft; and shooting high-performance concrete of which a slump, increased due to the bubbles, is reduced to fall within a range of slump of normal concrete while dissipating the bubbles from the mixed concrete by discharging the mixed concrete using air at a high pressure of 5 atm or more.

Advantageous Effects

According to the present invention, high-performance concrete is formed in a manner in which bubbles, which are to be removed, are added together with an admixture to pre-blended normal concrete so that the admixture is uniformly dispersed in the normal concrete using the ball-bearing effect of the bubbles, thus forming mixed concrete, and the mixed concrete is discharged using high-pressure air to thereby shoot high-performance concrete of which the slump, which is remarkably increased due to the large amount of bubbles, is reduced to fall within the range of slump of normal concrete while dissipating excess air from the mixed concrete, advantageously ensuring high strength and high durability.

Also, according to the present invention, high-performance concrete can be manufactured onsite in only the amount that is desired, thus reducing production and construction costs, thereby generating economic benefits.

DESCRIPTION OF THE REFERENCE NUMERALS IN THE DRAWINGS

100: apparatus for manufacturing high-performance concrete
110: normal concrete formation unit
120: bubble and admixture feeding unit
130: mixed concrete formation unit
140: high-performance concrete shooting unit

MODE FOR INVENTION

Figure 1:
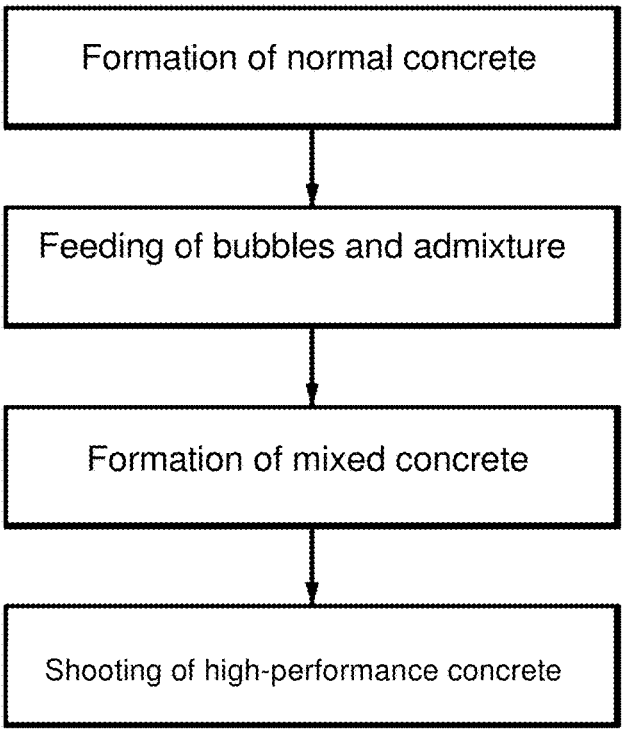
FIG. 1 is a flowchart illustrating the process according to the present invention.
Figure 2:
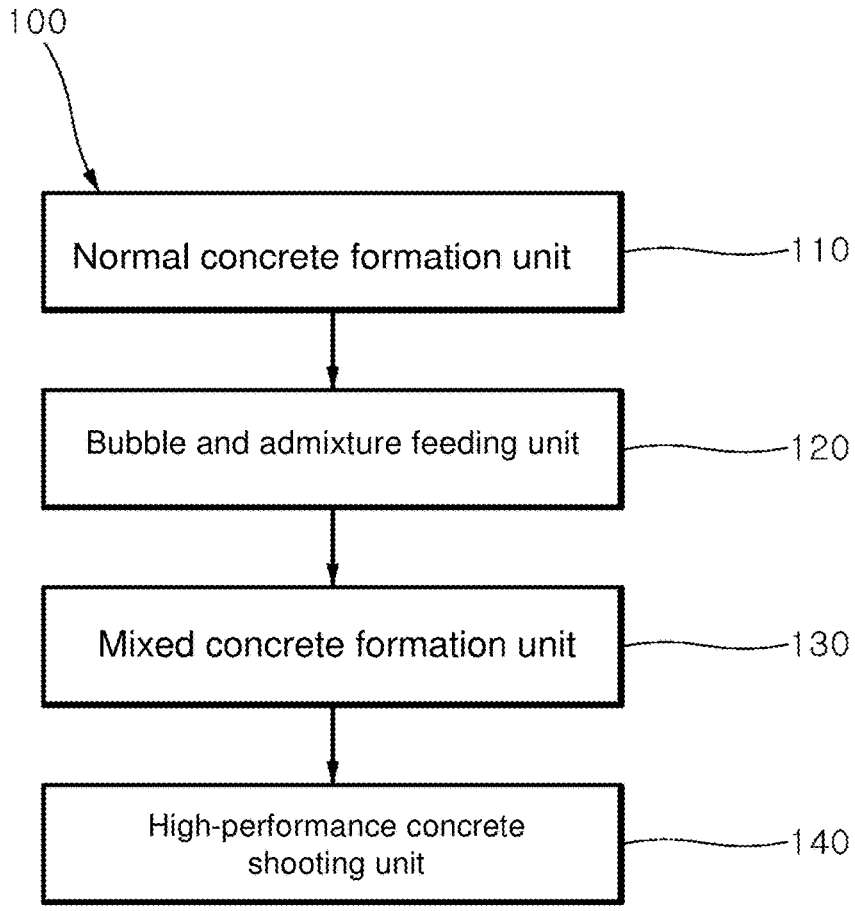
FIG. 2 is a schematic view illustrating the apparatus according to the present invention.

Hereinafter, a detailed description will be given of the present invention with the appended drawings. FIG. 1 is a flowchart illustrating the process according to the present invention, and FIG. 2 is a schematic view illustrating the apparatus according to the present invention.

According to the present invention, the apparatus 100 for manufacturing high-performance concrete by introducing air into normal concrete and dissipating air comprises: a normal concrete formation unit 110 for forming normal concrete by blending water, cement and aggregate at a predetermined ratio, a bubble and admixture feeding unit 120 for feeding bubbles and an admixture to the normal concrete to increase the slump of the normal concrete, a mixed concrete formation unit 130 including a shaft 131 that is rotated by the power of a motor in an agitator truck containing the normal concrete and a mixing member 132 having one or more blades radially provided to the shaft 131 so that the normal concrete is mixed with the bubbles and the admixture, fed from the bubble and admixture feeding unit 120, to form mixed concrete, and a high-performance concrete shooting unit 140 for shooting high-performance concrete of which the slump, which is increased due to the bubbles, is reduced to fall within the range of slump of normal concrete while dissipating the bubbles from the mixed concrete by discharging the mixed concrete using air at a high pressure of 5 atm or more.

Also, the apparatus 100 for manufacturing high-performance concrete by introducing air into normal concrete and dissipating air according to the present invention comprises: a normal concrete formation unit 110 for forming normal concrete by blending water, cement and aggregate at a predetermined ratio, a bubble and admixture feeding unit 120 for feeding bubbles and an admixture to the normal concrete to increase the slump of the normal concrete, a mixed concrete formation unit 130' including a hopper 133 that receives the normal concrete, the bubbles and the admixture and a mixing member 135 for mixing the bubbles and the admixture, fed from the bubble and admixture feeding unit 120, together with the normal concrete, which are fed into the hopper 133, by the rotation of a screw 134 to form mixed concrete, and a high-performance concrete shooting unit 140 for shooting high-performance concrete of which the slump, which is increased due to the bubbles, is reduced to fall within the range of slump of normal concrete while dissipating the bubbles from the mixed concrete by discharging the mixed concrete using air at a high pressure of 5 atm or more.

The bubble and admixture feeding unit 120 is preferably operated to feed foamed slurry, resulting from mixing the bubbles and slurry.

The bubble and admixture feeding unit 120 is operated to sequentially feed the bubbles and slurry to the normal concrete.

The slurry is preferably prepared by blending the admixture with water.

The bubble and admixture feeding unit 120 is operated to sequentially feed the bubbles and the admixture to the normal concrete.

The admixture preferably comprises any one or more selected from among silica fume, metakaolin, flyash, blast slag powder, latex, and a polymer.

The silica fume is used in an amount of 5 to 15 parts by weight based on 100 parts by weight of the cement for normal concrete.

The metakaolin is used in an amount of 7 to 20 parts by weight based on 100 parts by weight of the cement for normal concrete.

The flyash and the blast slag powder are used in amounts of 15 to 25 parts by weight based on 100 parts by weight of the cement for normal concrete.

The latex and the polymer are used in amounts of 3 to 15 parts by weight based on 100 parts by weight of the cement for normal concrete.

The bubbles are generated using a foaming agent and a bubble generator or a blowing agent, and are introduced in an amount of 20 to 40% based on 100% of the normal concrete.

The admixture is uniformly dispersed in the normal concrete by virtue of the large amount of bubbles, thus forming mixed concrete, and an antifoaming agent is added to the mixed concrete to eliminate excess bubbles from the normal concrete so as to realize high-performance concrete having a desired slump and strength.

The high-performance concrete shooting unit 140 includes a shooting guide member 141, which is removably attached to the mixed concrete formation unit 130 and is configured such that the center thereof has a smaller diameter than both ends, which communicate with each other, so as to discharge the mixed concrete in a compressed state, and an air supply path 142 formed through the shooting guide member to supply air at a high pressure of 5 atm or more so as to reduce the air content while dissipating the bubbles from the mixed concrete that is moved to the shooting guide member 141.

The air supply path 142 is radially inclinedly formed at the outer surface of the shooting guide member.

Below is a description of the manufacturing process according to the present invention.

Figure 3:
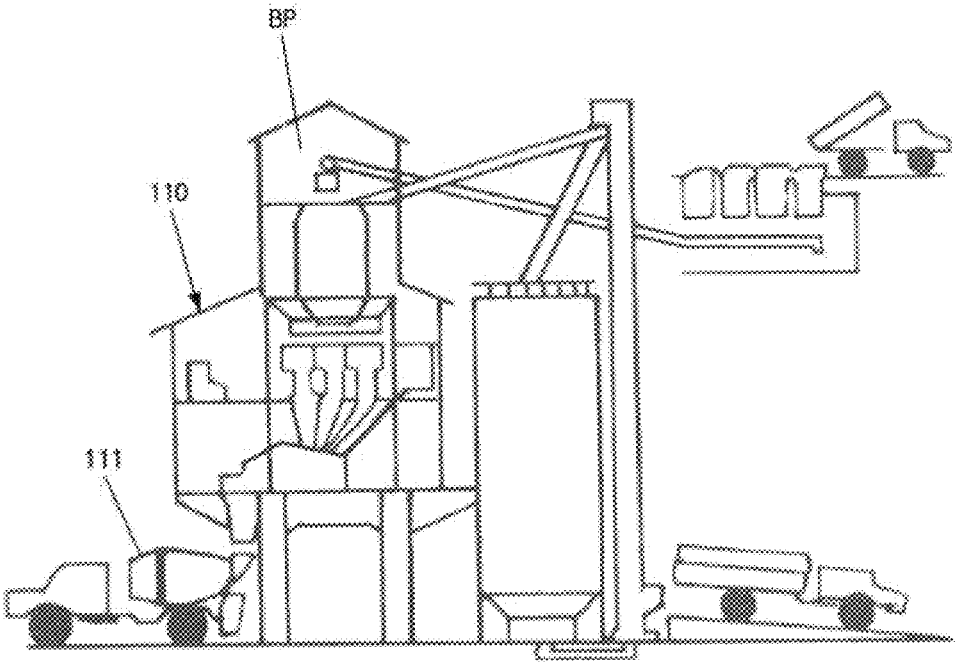
FIG. 3 illustrates the normal concrete formation unit according to the present invention.

As illustrated in FIG. 3, water, cement and aggregate, which are fed from a batching plant (BP), are blended and mixed at a predetermined ratio, thus forming normal concrete having a slump of 60 mm or more, which is then transported to the construction site using an agitator truck 111.

Normal concrete having a slump of 40 mm or less, obtained by blending and mixing water, cement and aggregate, which are fed from a batching plant (BP), at a predetermined ratio, is transported to the construction site using a dump truck.

Figure 4:
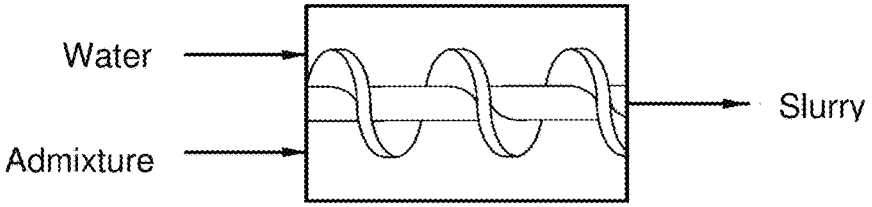
FIG. 4 illustrates the production of slurry according to the present invention.
Figure 5:
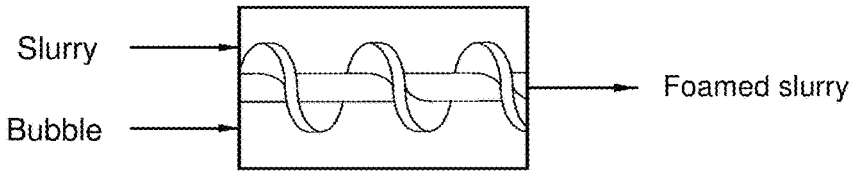
FIG. 5 illustrates the production of foamed slurry according to the present invention.

As illustrated in FIGS. 4 and 5, the admixture such as silica fume, metakaolin, flyash, latex, or polymer, fed from the bubble and admixture feeding unit 120, is blended with water at a ratio of 1:1 using a mixer such as a screw to thus produce a slurry, which is then mixed with bubbles generated using a foaming agent and a bubble generator, by means of a mixer such as a screw, thus obtaining a foamed slurry, after which the foamed slurry is added to normal concrete. The foamed slurry is preferably obtained by blending 1 kg of the admixture with 8 to 10 L of the bubbles, the exact ratio being appropriately determined in consideration of the desired slump and strength of the high-performance concrete.

The foaming agent is used to separately add bubbles to pre-blended normal concrete, and functions to physically feed bubbles through a surface-active action by being diluted with water in an amount corresponding to 30 to 50 times the amount thereof, thereby obtaining air content up to about 80%. In the present invention, the effective amount of the bubbles is preferably set so that the air content is 20 to 40% based on the total amount of high-performance concrete, and the bubbles have a shape close to a spherical shape and a size of 0.01 to 0.3 mm, smaller bubbles being preferable.

The bubbles may be generated using a blowing agent. In the course of addition of normal concrete with a blowing agent, stirring and re-mixing, bubbles are generated. The bubbles are initially formed to have a large size due to the high-speed rotation of the mixer, and the size thereof is decreased during the stirring, thus obtaining a comparatively uniform bubble size distribution, but the amount of bubbles that are generated may vary depending on the mixing time. The blowing agent may include an aluminum powder, and is preferably used in an amount of 0.1 to 0.5% based on the total amount of high-performance concrete.

Figure 6:
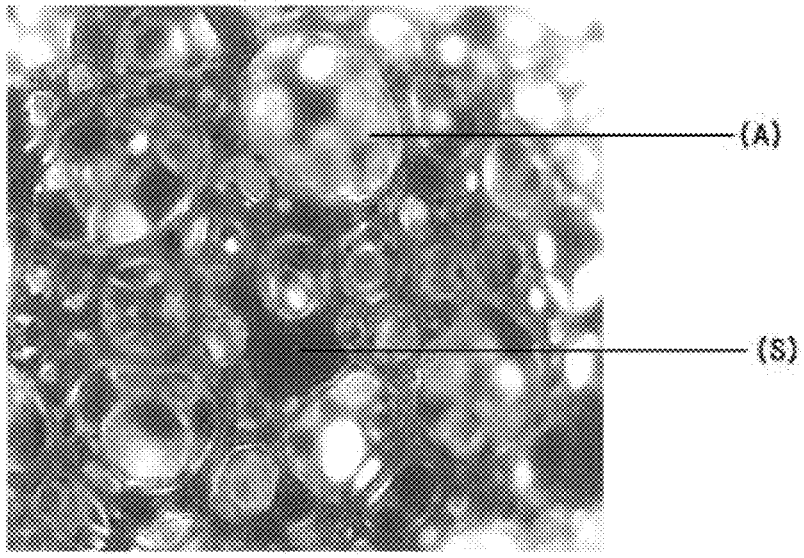
FIG. 6 is an enlarged image illustrating the foamed slurry produced in FIG. 5.

An enlarged image of the foamed slurry including bubbles and silica fume is illustrated in FIG. 6. The bubbles A contained in the foamed slurry have a size of about 0.1 to 1 mm, and the foamed slurry is configured such that the admixture including silica fume S is uniformly distributed between the bubbles.

The addition of the foamed slurry comprising the slurry and the bubbles to normal concrete is as described above, but the bubbles and the slurry may be sequentially added to the normal concrete.

Alternatively, instead of preparing the slurry, the normal concrete may be sequentially added with bubbles and an admixture, for example, any one or more selected from among silica fume, metakaolin, flyash, slag powder, latex, and a polymer. The silica fume is used in an amount of 5 to 15 parts by weight based on 100 parts by weight of cement for normal concrete, the metakaolin is used in an amount of 7 to 20 parts by weight based on 100 parts by weight of cement for normal concrete, the flyash and the blast slag powder are used in amounts of 15 to 25 parts by weight based on 100 parts by weight of cement for normal concrete, and the latex and the polymer are used in amounts of 3 to 15 parts by weight based on 100 parts by weight of cement for normal concrete. If the amount of the corresponding component is less than the lower limit, strength and durability may be decreased. On the other hand, if the amount thereof exceeds the upper limit, strength and durability are not further increased and construction costs may increase.

The foamed slurry or the bubbles and the admixture, fed from the bubble and admixture feeding unit 120, are mixed with the normal concrete in the mixed concrete formation unit 130. The mixing ratio of the normal concrete and the foamed slurry is as follows. The foamed slurry is used in an amount of 300 to 400 L relative to 1 $m^3$ of the normal concrete, whereby the bubbles are contained in an amount of 30 to 35% in the mixed concrete.

Figure 7:
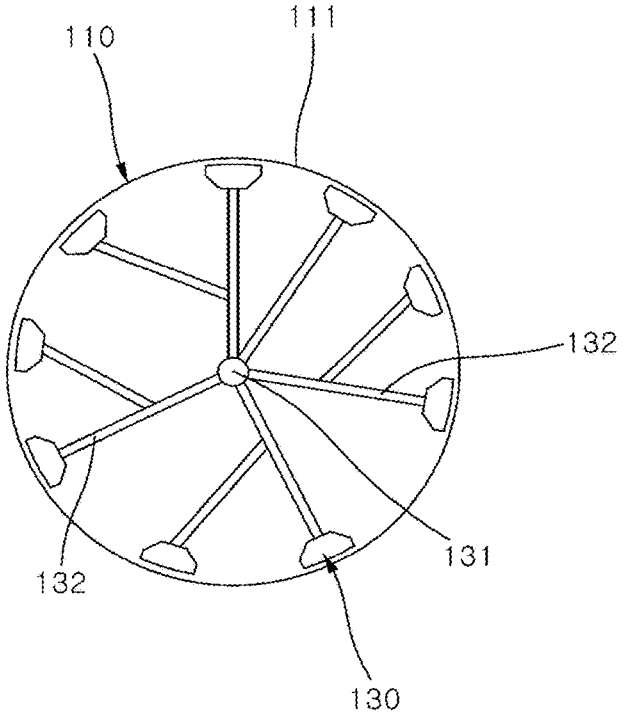
FIGS. 7 and 8 illustrate the mixed concrete formation unit according to an embodiment of the present invention.
Figure 8:
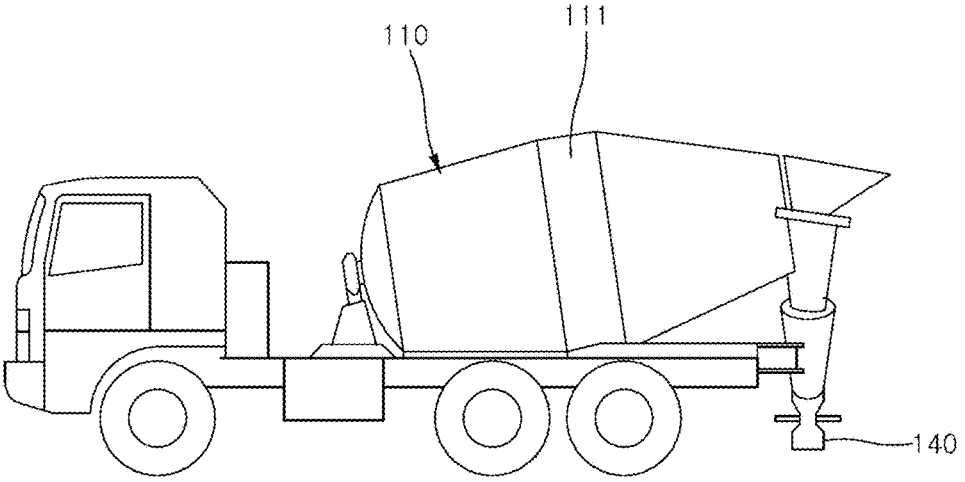

As illustrated in FIGS. 7 and 8, the mixed concrete formation unit 130 is operated in a manner in which the shaft 131 is rotated by the power of a motor (not shown) in the agitator truck 111, and simultaneously the mixing member 132, having one or more blades radially provided to the shaft 131, is rotated, whereby the normal concrete and the foamed slurry or the bubbles and the admixture or the blowing agent and the admixture are mixed, thus forming mixed concrete in which the admixture is efficiently dispersed in normal concrete using the ball-bearing effect of the bubbles.

Figure 9:
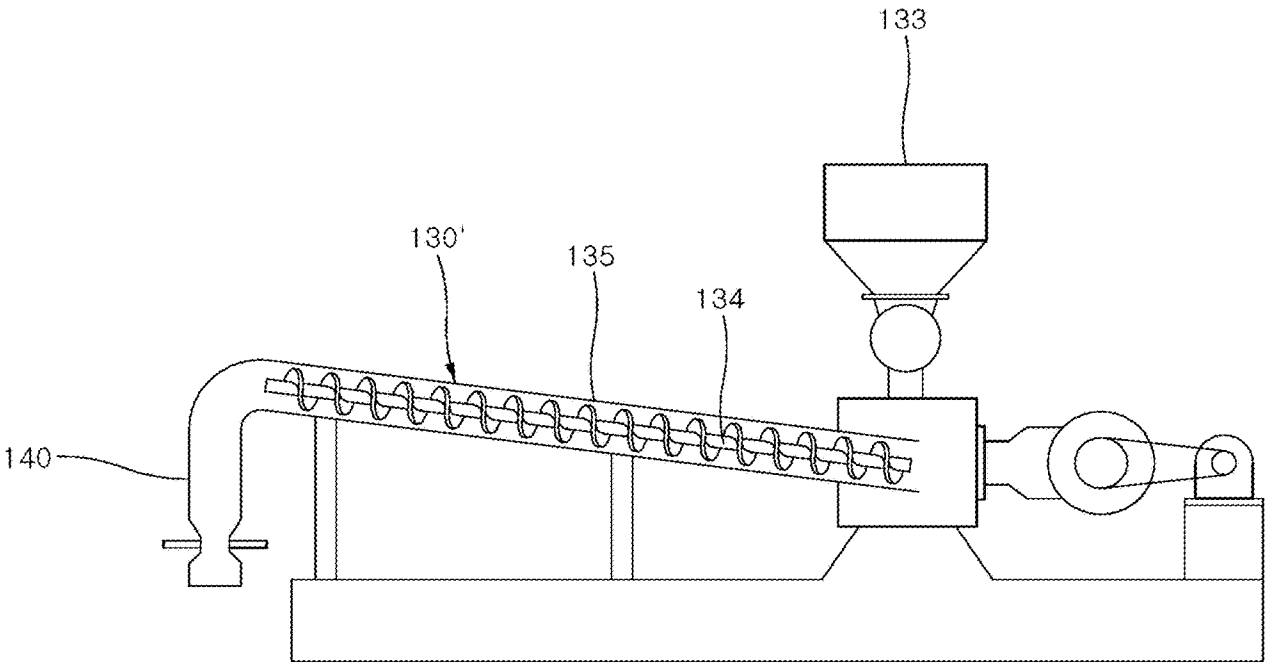
FIG. 9 illustrates the mixed concrete according to another embodiment of the present invention.

As illustrated in FIG. 9, the normal concrete having a slump of 40 mm or less is transported by a dump truck and then fed into the hopper 133 of the mixed concrete formation unit 130', the normal concrete fed into the hopper 133 is transferred to the mixing member 135 through the rotation of the screw 134, and the normal concrete transferred to the mixing member 135 is added with the bubbles and the admixture, fed from the bubble and admixture feeding unit 120, and then mixed together through the rotation of the screw 134.

Although the bubbles and the admixture may be separately added, the mixing time of the bubbles, the admixture and the normal concrete through the rotation of the screw 134 is short, and thus, the addition of the foamed slurry to normal concrete is preferable.

The mixed concrete formation unit 130' is an up-down stirring mixer, and is inclinedly formed so that the inlet is positioned lower than the outlet, whereby the foamed slurry and the normal concrete may be easily mixed due to the height difference of the mixing member 135.

When the weight ratio of the admixture, such as silica fume, metakaolin, blast slag powder, latex or polymer, with the water, which together constitute the slurry, is set to 1:1, 1.5 kg of the admixture such as silica fume is mixed with 1.5 kg of water, thus producing a slurry. The ratio of the water and the admixture such as silica fume is determined in consideration of the slump and strength of the final high-performance concrete.

Figure 10:
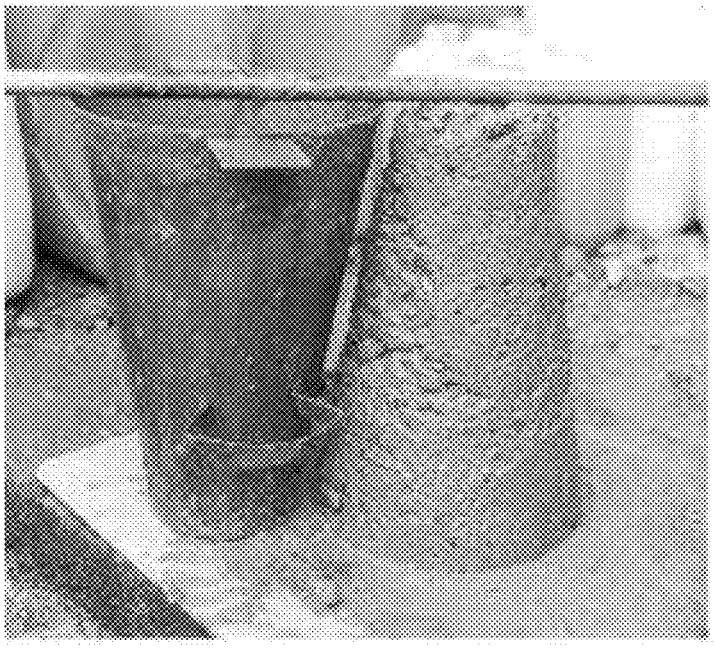
FIGS. 10 and 11 are images illustrating the slumps of normal concrete and mixed concrete according to the present invention.
Figure 11:
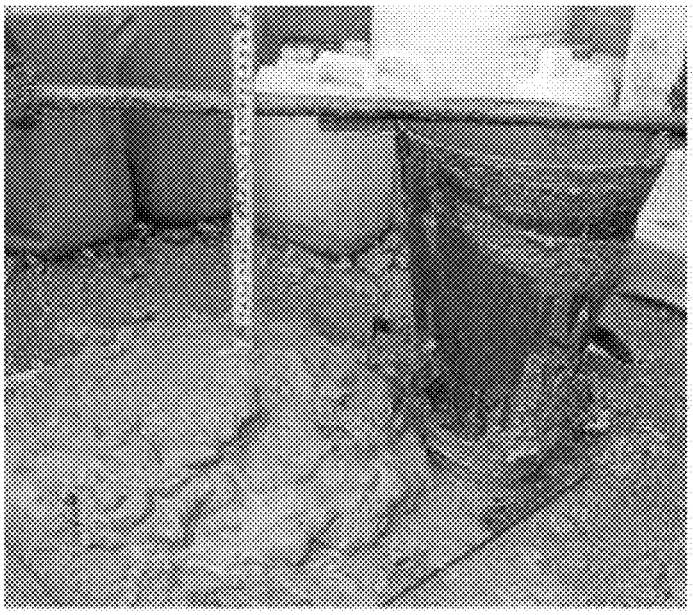

FIG. 10 illustrates the slump of normal concrete. The mixing ratio of water, cement and aggregate, which are contained in normal concrete, is dependent on the typical standard ratio, and the slump is 0 mm. FIG. 11 illustrates a slump of 230 mm, attained by mixing the foamed slurry with the normal concrete. In FIG. 10, the air content is 3% in the normal concrete before blending the normal concrete with the foamed slurry, but in FIG. 11, the air content is remarkably increased to 26% in the mixed concrete resulting from blending the normal concrete with the foamed slurry.

The increased amount of air enables the admixture to be uniformly dispersed in the normal concrete through a ball-bearing effect. However, the mixed concrete containing a large amount of air is considerably decreased in strength and durability. Typically, the relationship between the air content of normal concrete and the compressive strength thereof is such that when the air content of normal concrete is increased by 1%, compressive strength is decreased by about 4%. Specifically, the strength of the mixed concrete containing a large amount of bubbles is remarkably decreased, and is thus difficult to use as a structural material, and the slump thereof is considerably increased, undesirably resulting in poor workability when casting the mixed concrete.

Figure 12:
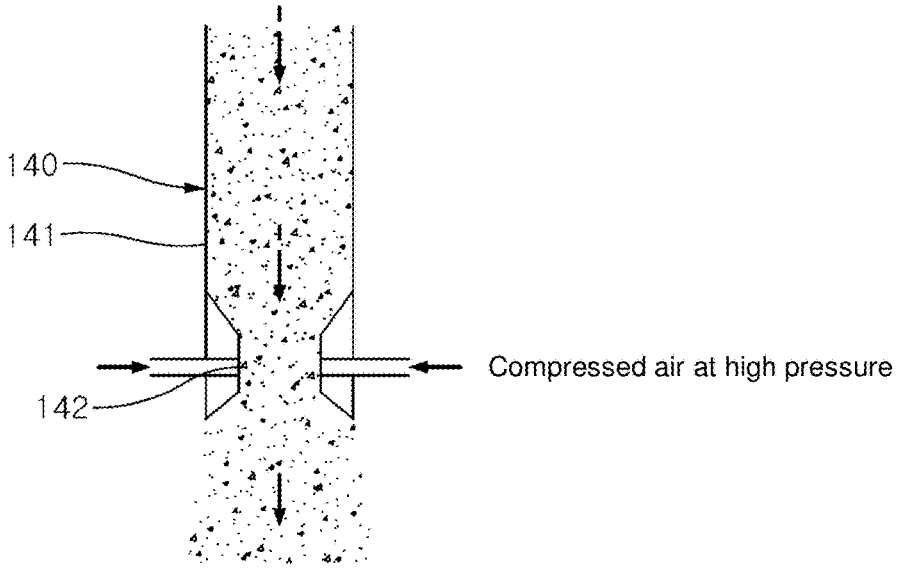
FIGS. 12 and 13 illustrate the shooting of the high-performance concrete using the high-performance concrete shooting unit according to the present invention.
Figure 13:
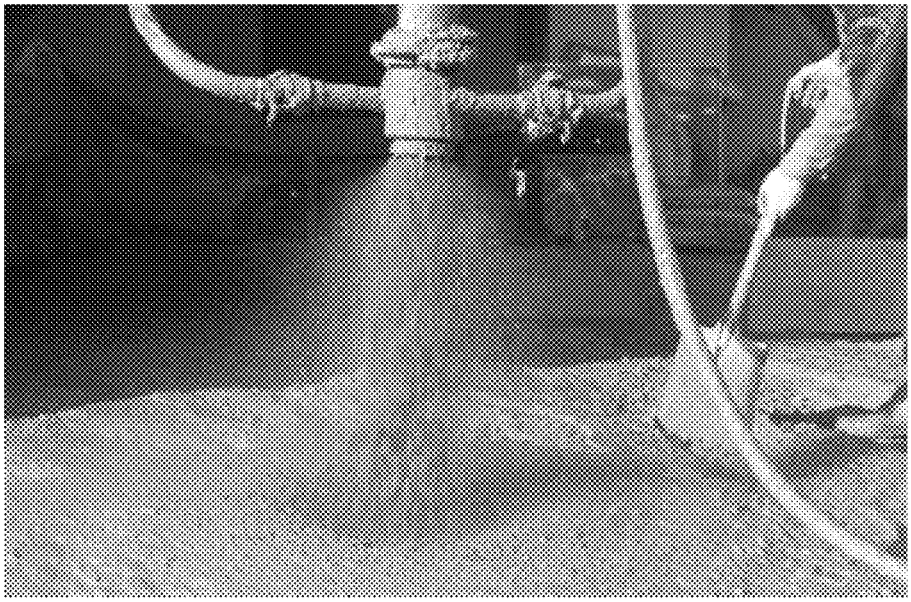

Hence, as illustrated in FIGS. 12 and 13, in order to decrease the large amount of air contained in the mixed concrete in the mixed concrete formation unit 130, an antifoaming agent is added to the mixed concrete, or shooting is performed using the high-performance concrete shooting unit 140.

The antifoaming agent is added to the mixed concrete to remove the bubbles, which function to uniformly disperse the admixture in the normal concrete.

The antifoaming agent is a material for suppressing the generation of bubbles, and may be referred to as a foam breaker for breaking the generated bubbles or a foam inhibitor for inhibiting the generation of bubbles. In the present invention, the foam breaker may be used to remove excess bubbles, which are already present. A variety of antifoaming agents may be applied to the mixed concrete, and the antifoaming agent is preferably used in an amount of 0.1 to 2.0 parts by weight based on 100 parts by weight of high-performance concrete.

In the shooting of the mixed concrete using the high-performance concrete shooting unit 140, it is supplied to the inlet of the shooting guide member 141 removably attached to the agitator truck 111 of the mixed concrete formation unit 130 or the mixing member 135 of the mixed concrete formation unit 130'.

Here, the shooting guide member 141 is configured such that the center thereof has a smaller diameter than the inlet and outlet at respective ends, which communicate with each other, and pressure is increased while the mixed concrete guided to the shooting guide member 141 is compressed.

Figure 14:
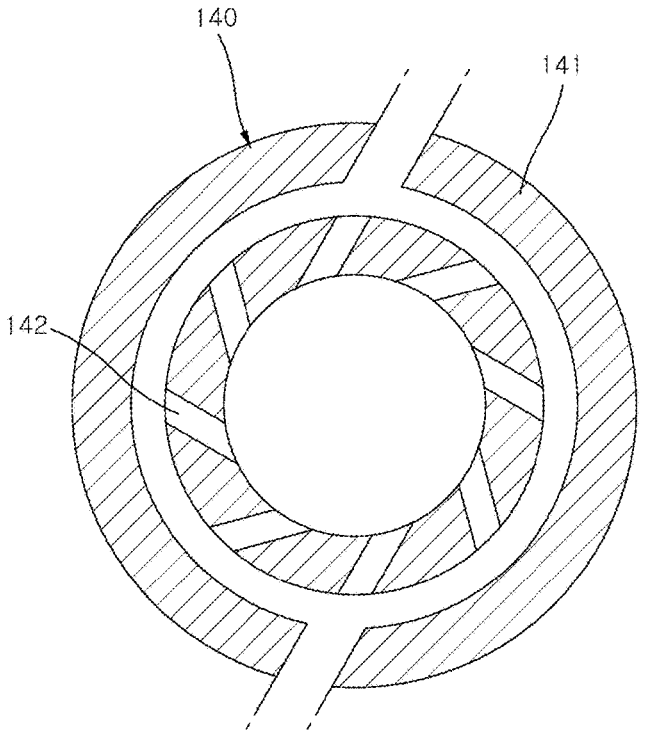
FIG. 14 is a top plan view illustrating the high-performance concrete shooting unit according to the present invention.

As illustrated in FIG. 14, while the mixed concrete is passed through the center of the shooting guide member 141 and then through the outlet of the shooting guide member 141, which has a diameter greater than the center thereof, compressed air at a high pressure of 5 atm or more is fed to the air supply path 142, which is radially inclinedly formed at the outer surface of the shooting guide member 141, thereby shooting the mixed concrete in vortex form to the outlet of the shooting guide member 141. The compressed air and the mixed concrete are emitted in a spraying manner. Upon spraying, while the compressed air and the mixed concrete come into contact with each other, the large amount of bubbles contained in the mixed concrete is dissipated.

Figure 15:
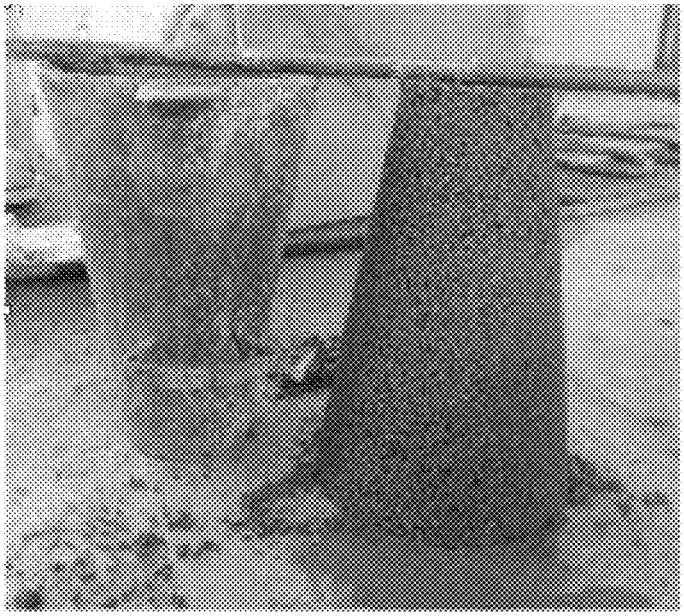
FIG. 15 is an image illustrating the slump of the high-performance concrete according to the present invention.
Figure 16:
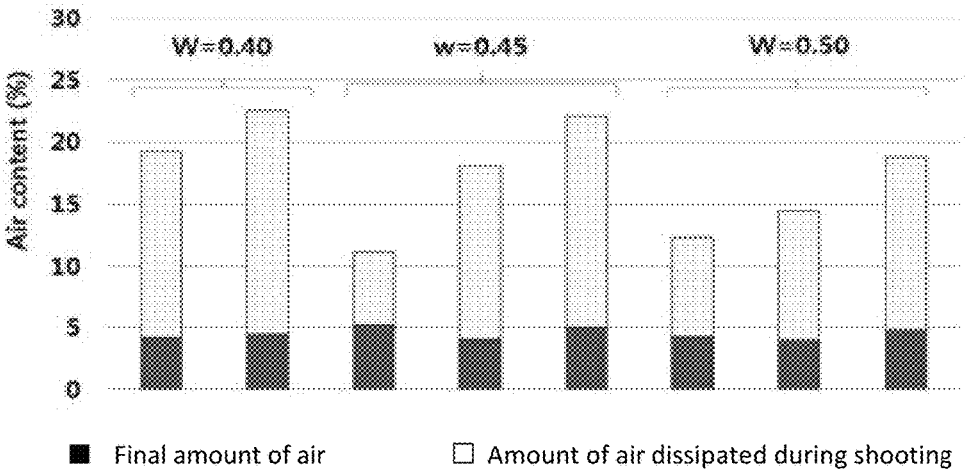
FIG. 16 is a graph illustrating the air content in the high-performance concrete after shooting using the high-performance concrete shooting unit according to the present invention.

As illustrated in FIGS. 15 and 16, the air content in the mixed concrete after dissipation of the bubbles is close to the air content of normal concrete before the addition of the foamed slurry. As the air content in the mixed concrete is decreased to 3 to 7%, the slump thereof is decreased to the original slump level, thereby enabling shooting of high-performance concrete having desired workability, high strength and high durability. Table 1 below shows the slump and air content of normal concrete before mixing with the foamed slurry, mixed concrete containing the foamed slurry, and high-performance concrete after shooting, with regard to dry concrete having a slump of 0 mm and typical concrete having a slump of 80 mm.

TABLE 1

| Kind of normal concrete | State of concrete | Slump (mm) | Air content (%) |
|---|---|---|---|
| Dry concrete (slump: 0 mm) | Normal concrete | 0 | 4.2 |
| | Mixed concrete containing foamed slurry | 200 | 26.0 |
| | High-performance concrete after shooting | 0 | 4.3 |
| Typical concrete (slump: 80 mm) | Normal concrete | 80 | 6.5 |
| | Mixed concrete containing foamed slurry | 270 | 37.0 |
| | High-performance concrete after shooting | 125 | 4.5 |

Although the preferred embodiments of the present invention have been disclosed for illustrative purposes, they are not to be construed as limiting the present invention. Any embodiment may be incorporated in the scope of the present invention, so long as it has substantially the same configuration as in the spirit of the claims of the invention and shows the same effects.

In particular, in embodiments of the present invention, the admixture is exemplified by silica fume, metakaolin, flyash, blast slag powder, latex, and polymer, but any other admixture may be applied to the apparatus and method of the invention so long as it may improve the properties of the normal concrete and generate economic benefits.

What is claimed is:

1. An apparatus for manufacturing high-performance concrete by introducing air into normal concrete and dissipating air, comprising:

a normal concrete formation unit for forming normal concrete by blending water, cement, and aggregate at a predetermined ratio;

a bubble and admixture feeding unit for feeding bubbles and an admixture to the normal concrete to increase a slump of the normal concrete;

a mixed concrete formation unit, comprising a shaft that is rotated by power of a motor in an agitator truck containing the normal concrete, and a mixing member having one or more blades radially provided to the shaft to mix the normal concrete with the bubbles and the admixture, fed from the bubble and admixture feeding unit, thus forming mixed concrete; and a high-performance concrete shooting unit for shooting high-performance concrete of which a slump, increased due to the bubbles, is reduced to fall within a range of slump of normal concrete while dissipating the bubbles from the mixed concrete by discharging the mixed concrete using air at a high pressure of 5 atm or more.

2. The apparatus of claim 1, wherein the bubble and admixture feeding unit is operated to feed a foamed slurry resulting from mixing the bubbles and a slurry.

3. The apparatus of claim 2, wherein the slurry is produced by blending the admixture with water.

4. The apparatus of claim 1, wherein the bubble and admixture feeding unit is operated to sequentially feed the bubbles and a slurry to the normal concrete.

5. The apparatus of claim 4, wherein the slurry is produced by blending the admixture with water.

6. The apparatus of claim 1, wherein the bubble and admixture feeding unit is operated to sequentially feed the bubbles and the admixture to the normal concrete.

7. The apparatus of claim 6, wherein the admixture comprises any one or more selected from among silica fume, metakaolin, flyash, blast slag powder, latex, and a polymer.

8. The apparatus of claim 7, wherein the silica fume is used in an amount of 5 to 15 parts by weight based on 100 parts by weight of cement for normal concrete.

9. The apparatus of claim 7, wherein the metakaolin is used in an amount of 7 to 20 parts by weight based on 100 parts by weight of cement for normal concrete.

10. The apparatus of claim 7, wherein the flyash and the blast slag powder are used in amounts of 15 to 25 parts by weight based on 100 parts by weight of cement for normal concrete.

11. The apparatus of claim 7, wherein the latex and the polymer are used in amounts of 3 to 15 parts by weight based on 100 parts by weight of cement for normal concrete.

12. The apparatus of claim 1, wherein the bubbles are generated using a foaming agent and a bubble generator.

13. The apparatus of claim 12, wherein the mixed concrete is added with an antifoaming agent so as to eliminate excess air introduced by the foaming agent and the bubble generator.

14. The apparatus of claim 1, wherein the bubbles are generated using a blowing agent.

15. The apparatus of claim 14, wherein the mixed concrete is added with an antifoaming agent so as to eliminate excess air introduced by the blowing agent.

16. The apparatus of claim 1, wherein the high-performance concrete shooting unit comprises:

a shooting guide member removably attached to the mixed concrete formation unit and configured such that a center thereof has a smaller diameter than both ends thereof, which communicate with each other, so that the mixed concrete is discharged in a compressed state; and an air supply path formed through the shooting guide member to supply air at a high pressure of 5 atm or more so as to reduce an amount of air while dissipating the bubbles from the mixed concrete that is moved to the shooting guide member.

17. The apparatus of claim 16, wherein the air supply path is radially inclinedly formed at an outer surface of the shooting guide member.

* * * * *